US005375045A

United States Patent [19]

Ruud et al.

[11] Patent Number: 5,375,045

[45] Date of Patent: Dec. 20, 1994

[54] LIGHTING SYSTEM FOR ILLUMINATING ROOF PORTIONS HAVING DISPARATE SLOPES

[75] Inventors: Alan J. Ruud, Racine; Eric J. Haugaard, Kenosha, both of Wis.

[73] Assignee: Ruud Lighting, Inc., Racine, Wis.

[21] Appl. No.: 225,135

[22] Filed: Apr. 8, 1994

[51] Int. Cl.[5] ..... E04F 19/00

[52] U.S. Cl. ..... 362/147; 362/145; 52/28

[58] Field of Search ..... 362/145, 147, 217, 225, 362/362; 52/28

[56] References Cited

U.S. PATENT DOCUMENTS

| | | | |
|---|---|---|---|
| 1,249,500 | 12/1917 | Richter | 362/147 |
| 1,713,050 | 5/1929 | Natzel | 52/28 |
| 1,780,125 | 10/1930 | Goodhouse | 362/147 X |
| 1,836,647 | 12/1931 | Crumpton | 362/145 |
| 2,640,143 | 5/1953 | Malone | 362/240 |
| 2,964,616 | 12/1960 | Seidman | 362/217 |
| 3,855,463 | 12/1974 | Fowler | 52/28 X |
| 4,027,151 | 5/1977 | Barthel | 362/217 |
| 4,156,270 | 5/1979 | Beatty | 362/145 |
| 4,300,185 | 11/1981 | Wakamatsu | 362/147 X |
| 4,349,866 | 9/1982 | Molnar | 362/147 X |
| 4,434,453 | 2/1984 | Campbell | 362/145 X |
| 4,517,631 | 5/1985 | Mullins | 362/217 X |
| 4,564,888 | 1/1986 | Lewin et al. | 362/147 |
| 4,725,931 | 2/1988 | Bourdon | 362/147 |
| 4,748,543 | 5/1988 | Swarens | 362/147 |
| 4,760,505 | 7/1988 | Cole, Jr. | 362/147 X |
| 4,905,126 | 2/1990 | Faia | 362/147 X |
| 4,932,170 | 6/1990 | Spear | 52/28 |
| 5,032,958 | 7/1991 | Harwood | 362/217 |
| 5,081,567 | 1/1992 | Weiss | 362/147 |
| 5,146,393 | 9/1992 | Crane | 362/147 X |
| 5,160,193 | 11/1992 | Fabbri et al. | 362/147 X |

*Primary Examiner*—Ira S. Lazarus
*Assistant Examiner*—Thomas M. Sember
*Attorney, Agent, or Firm*—Jansson & Shupe, Ltd.

[57] ABSTRACT

Improved lighting apparatus for illuminating roofs having characteristic disparate slopes. Such apparatus includes at least one housing secured along the top edge of such roof, preferably between adjacent pairs of decorative beams. The apparatus has an elongate light source therealong and a reflector to direct light toward two disparate-sloping roof sections for bright and even illumination. A shroud along the housing prevents glare beyond the lower edge of the roof. The housing is preferably movably mounted for easy servicing.

18 Claims, 5 Drawing Sheets

LIGHTING SYSTEM FOR ILLUMINATING ROOF PORTIONS HAVING DISPARATE SLOPES

FIELD OF THE INVENTION

This invention relates generally to lamp mounting and, more specifically, to lamp-mounting elongate roof fixtures.

BACKGROUND OF THE INVENTION

For over twenty years, McDonald's Corporation, which has well-known restaurants, has employed a characteristic roof design as part of its "signage". The McDonald's roof design consists of top, middle and lower roof portions. The top portion is horizontal and flat, spans the restaurant and forms the deck of the roof. The middle and lower roof portions are angled and intersect to form a valley. The middle and lower roof portions have disparate slopes; the middle portion is pitched at a greater angle than the lower portion.

During this period, McDonald's Corporation has used lamp-mounting elongate roof fixtures to illuminate the roofs of its restaurants. These light fixtures typically are positioned in or under a plurality of distinctive parallel-spaced roof beams which extend up the roof and over the lower and middle roof portions. All of such prior art roof-beam lighting systems have significant problems and disadvantages. This invention overcomes such problems and disadvantages.

For example, one version of such roof fixtures, still in wide use, does not completely illuminate the roof and is difficult to service. This system has as its light source either one centered fluorescent tube or a pair of parallel tubes, such tubes being mounted in spaces provided along the roof beam. Light from these tubes is emitted laterally from the roof beams onto the middle and lower roof portions which are adjacent to the beams and light fixtures. These fixtures give fairly intense light to the roof immediately adjacent to the beams, but provided very little light to most of the roof. In addition, service for such light fixtures is rather difficult and inconvenient because service personnel may be required to stand on the sloped roof portions to change a lamp or repair a fixture.

Still another of the prior roof-beam lighting fixtures uses what is known as a "Light-Pipe" optical system to achieve essentially the same result. The light from these fixtures, like that from the aforementioned fluorescent fixtures, is quite weak over most of each lower and middle portion of the roof.

Another McDonald's roof-beam lighting system, which is the subject of U.S. Pat. No. 5,081,567 (Weiss), involves placement of a bulb inside the roof beam at the lower end of the beam and adjacent to windows formed on either side of the beam. Such lamp is oriented along the beam and projects light through the windows onto the roof. This system provides brighter, but uneven, illumination and is rather inefficient in operation. Furthermore, such systems are considered to cause glare to observers at certain positions around the roof. Another problem is that such system has its ballast located at a position remote from the lamp, which can complicate service.

Another system overcoming certain of the problems of the Weiss system is described in U.S. application Ser. No. 07/981,605 (Ruud). Such system has improved brightness, efficiency and serviceability, but shares certain of the other problems mentioned above with respect to the Weiss system, particularly with respect to evenness of illumination.

All of the aforementioned roof-beam lighting systems share still another problem: All such lighting fixtures of the prior art are connected to or form parts of McDonald's roof beams. This tends to make them expensive, tends to impose limitations on efficiency of light use, and can complicate service. Furthermore, the roof beams themselves require structure which otherwise would not be needed.

An improved roof-lighting system for illuminating roofs of the disparate-slope type common on McDonald's Restaurants would be an important advance.

OBJECTS OF THE INVENTION

It is an object of the invention to provide an improved lamp-mounting elongate roof fixture overcoming some of the problems and shortcomings of the prior art.

Another object of the invention is to provide an improved roof-fixture lighting system which evenly and brightly illuminates roof portions having disparate slopes such as the roofs commonly employed by McDonald's Corporation.

Another object of the invention is to provide a lighting system for such roofs which gives a bright but even light level at positions along the roof, regardless of the proximity of a roof beam.

Yet another object of the invention is to provide a roof lighting system giving both improved brightness and improved energy efficiency.

Yet another object of the invention is to provide a lamp-mounting elongate roof fixture which reduces or eliminates glare.

Another object of the invention is to provide a lamp-mounting elongate roof fixture which is easy to maintain.

Still another object of this invention is to provide a lighting system for a roof having decorative beams allowing the beams to be simpler in construction.

These and other objects will be apparent from the invention descriptions which follow.

SUMMARY OF THE INVENTION

Briefly described, the present invention is a outdoor lighting system for uniformly lighting a roof, such as that commonly found on McDonald's Restaurants. In addition to a top flat (horizontal) roof portion, such roof has lower and middle roof portions which intersect and are pitched at different angles. The roof also has a plurality of spaced parallel roof beams which extend up the roof—across the lower and middle roof portions and onto the top roof portion.

The lighting system of this invention includes at least one elongated housing secured to the top edge of the roof and positioned between the beams. At least one lamp mounting fixture is secured within the housing for supporting a light source. A reflector is secured within the housing. The reflector extends behind and along the light source and is configured and arranged to direct light on the lower and middle portions of the disparately pitched roof. A shroud extending along the housing is positioned in front of the light source to limit transmission of light beyond the lower portion of the roof.

In a preferred embodiment, the housing and shroud project no higher than the upper end sections of the roof beams, and no higher than the distal surface of such roof beams at every position adjacent the beams. The housing and shroud are most preferably recessed below such roof beam distal surface.

The housing preferably forms a downwardly directed opening along substantially the entire length of the housing for projection of light toward the roof. The opening may be covered by a lens to protect the fixture from the environment.

It is highly preferred that the housing be movably attached along the top surface of the roof to facilitate service including changing lamps. The attachment may consist of a hinge permitting the housing to be pivoted rearwardly for access to the components within the housing.

A lamp-mounting fixture is preferably mounted within the housing and is most preferably of the type for receiving the socket of an elongate light source, such as an elongate fluorescent lamp with a socket-engaging member at one end.

The reflector is preferably configured and arranged to direct light in a manner silhouetting the distal surface of the roof beams. The reflector also has a curved profile to accomplish the objective of casting substantially uniform light over the middle and lower roof sections. Such reflector substantially surrounds the elongate light source.

In certain embodiments, the shroud is integrally formed with the housing, while in others a separate component is fastened to housing. Such shroud is most preferably substantially parallel to the middle portion of the roof. In highly preferred embodiments, the shroud has an undersurface which is reflective, for example, by means of a white or other light-colored surface, to enhance the lighting of the middle portion of the roof.

DETAILED DESCRIPTIONS OF THE PREFERRED EMBODIMENTS

Figure 1:
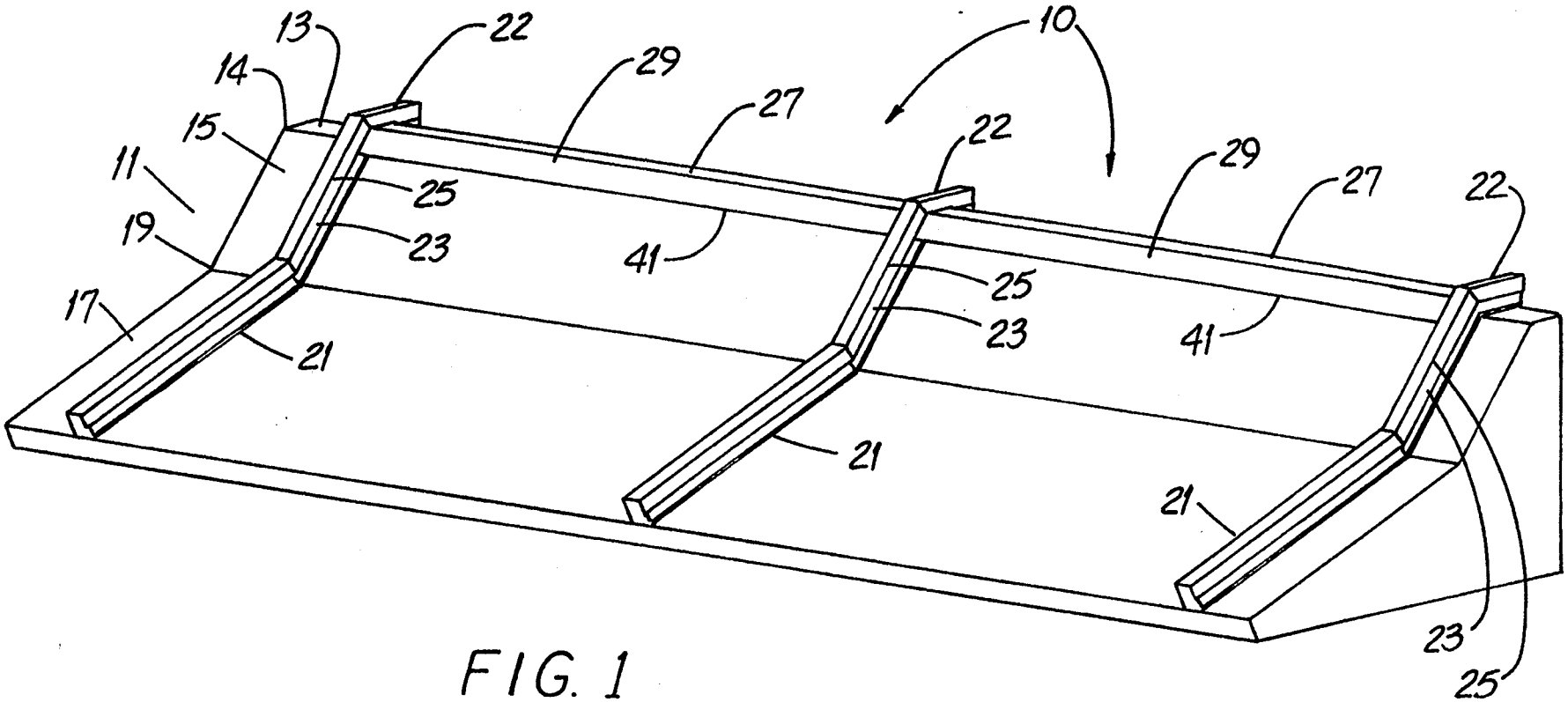
FIG. 1 is a perspective view of a portion of a typical McDonald's Restaurant roof having thereon a preferred embodiment of the roof lighting apparatus of this invention.

Referring first to FIG. 1, a typical McDonald's Restaurant roof 11 is shown having light fixture 10 of this invention. Roof 11 has a top portion 13, a middle portion 15, and a lower portion 17. Top and middle roof portions 13 and 15 intersect to form a top edge 14. Middle and lower roof portions 15 and 17 are angled and intersect to form a valley 19. Middle and lower portions 15 and 17 are pitched at disparate angles.

As with typical McDonald's Restaurant roofs, roof 11 has on it a plurality of parallel spaced roof beams 21. Each roof beam 21 extends up roof 11 over roof portions 17, 15 and 13. Each beam 21 has an upper end section 22 which extends over roof top portion 13, side surfaces 23 and a distal surface 25 extending along its full length.

Each light fixture 10 is secured to and extends along roof top edge 14 and is positioned between an adjacent pair of roof beams 21. More than one fixture 10 may be positioned between such roof beams 21, such fixtures being positioned end to end. Light fixture 10 includes an elongate housing 27 which is secured to top edge 14 of roof 11. Housing 27 has a shroud 29 which is integrally formed therewith, and a downwardly-directed opening 41 along substantially the entire length of housing 27 for projection of light toward roof 11 and, in particular, toward roof portions 15 and 17.

Housing 27 and shroud 29 are designed to blend in with and complement existing roof and beam designs which are characteristic of McDonald's Restaurants. For this reason, housing 27 and shroud 29 do not project above upper end beam sections 22 or beam distal surfaces 25, and, in fact, are recessed below distal surfaces 25.

Figure 2:
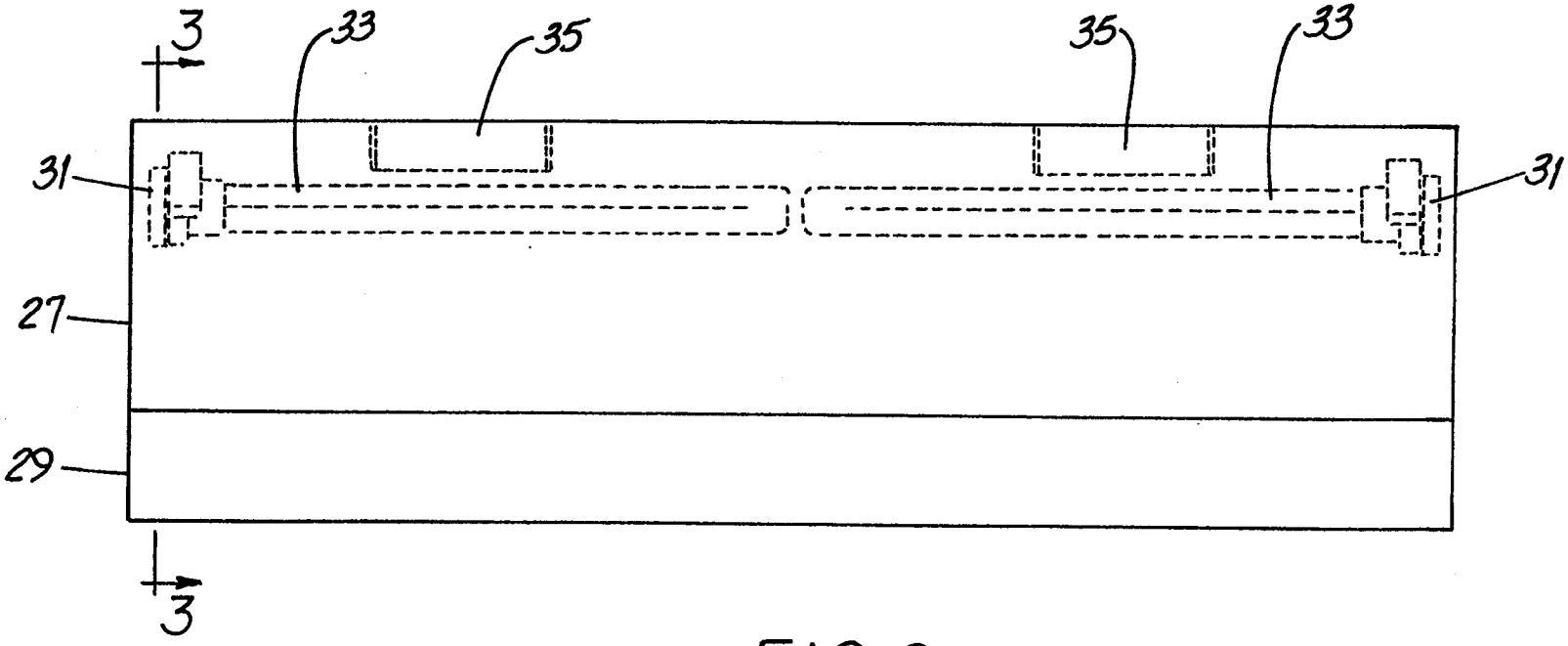
FIG. 2 is a top plan view of such lighting apparatus, with phantom lines to indicate positions of certain components within the housing.

FIG. 2 shows the positions of key elements within fixture 10. Within housing 27 is a light source which includes a lamp-mounting fixture 31, a lamp 33 and a ballast 35. Lamp-mounting fixture 31 is secured within housing 27 with suitable fasteners and is designed to support an elongate light source such as lamp 33. Lamp 33 is preferably an elongate fluorescent lamp of a type commonly available.

Lamp 33 mates with lamp-mounting fixture 31 by means of a standard socket arrangement (not shown). Fixture 10, as depicted in FIG. 2, includes two lamps 33 each of which is secured to housing 27 by a separate lamp mounting fixture 31 and is supplied with electrical current by a separate ballast 35. It is understood that a single fluorescent lamp could be utilized in place of the two lamps depicted in FIG. 2, and a variety of other elongate light sources could be used. Lamps 33 may be removed from light-mounting fixtures 31 for service or replacement.

Figure 3:
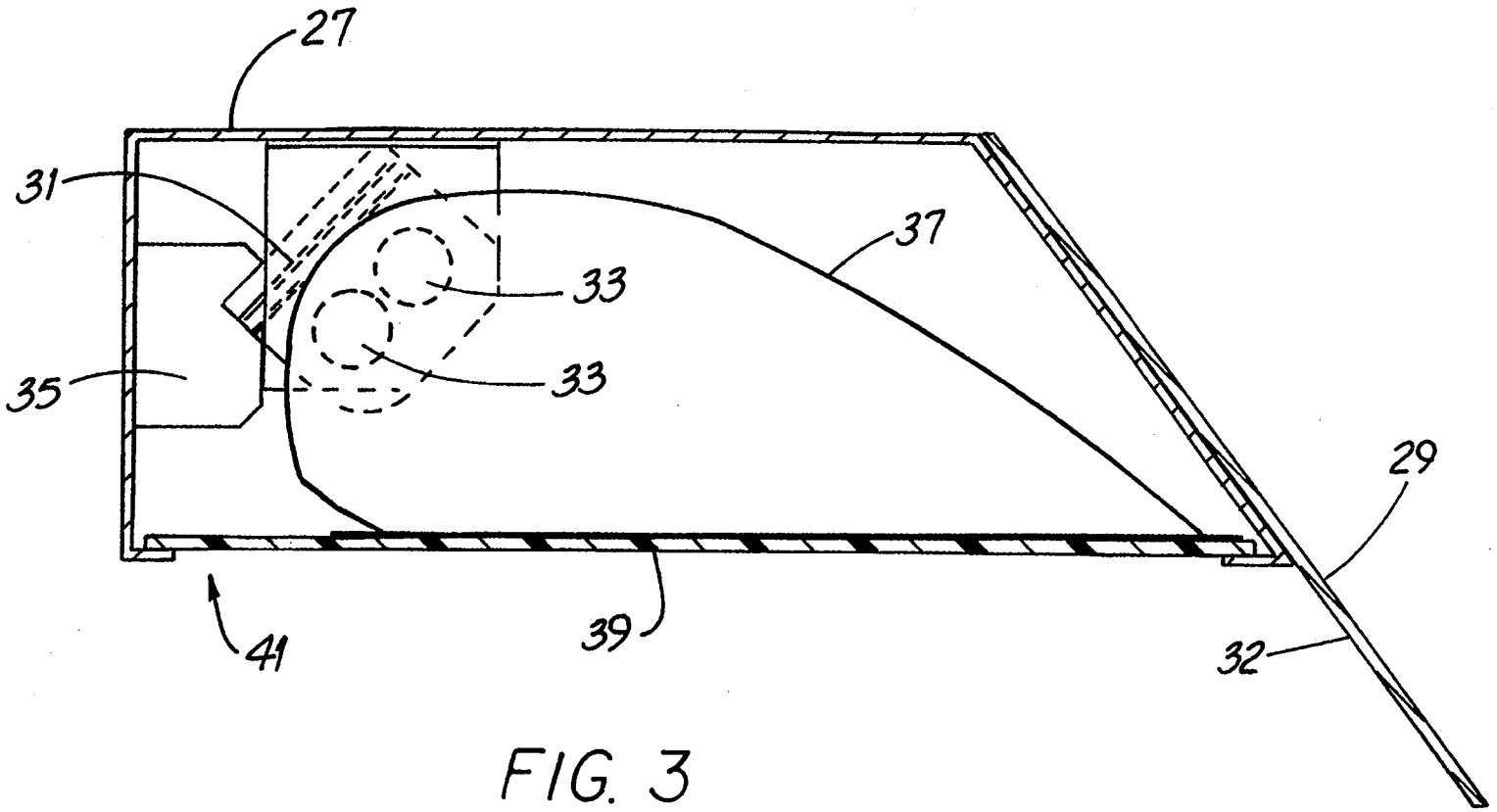
FIG. 3 is cross-section of the lighting apparatus taken along section 3—3 as indicated in FIG. 2, but having one minor variation over the construction of FIGS. 1 and 2.

FIG. 3 shows one relationship between housing 27 and shroud 29. Shroud 29 is secured to and extends along housing 27. Shroud 29 is positioned in front of the light source to limit light transmission beyond the lower edge of lower roof portion 17. Shroud 29 projects downwardly from the housing at an angle substantially parallel to roof middle section 15.

Housing 27 and shroud 29 may be made of any suitable material, but metallic materials such as steel or extruded aluminum are preferred. Undersurface 32 of shroud 29 may be coated with a reflective material (not shown) so as to enhance the lighting of roof middle portion 15.

Shroud 29, instead of being integrally formed with housing 27, can be a separate component attached to the housing 27, as shown in FIG. 3. In the case where more than one fixture 10 is placed between a pair of adjacent beams 21, shroud 29 may be a separate component attached to and unifying such plural fixtures.

FIG. 3 also illustrates the relative positions of 10 lamp-mounting fixture 31, lamp 33, ballast 35 and a curved reflector 37. Reflector 37 is positioned in housing 27 behind and along the light source. The profile of reflector 37, and reflector 37 is configured and arranged to provide uniform light distribution over roof middle and lower portions 15 and 17. Such arrangement allows the silhouetting of roof beams 21 against the brightly lit roof 11.

In one embodiment, reflector 37 substantially surrounds lamp 33. Reflector 37 is preferably made of aluminum but could be made of other reflective materials. Reflector 37 is secured within housing 27 by suitable fasteners. A lens 39 covers opening 41 in housing 27 through which light exits fixture 10.

Figure 4:
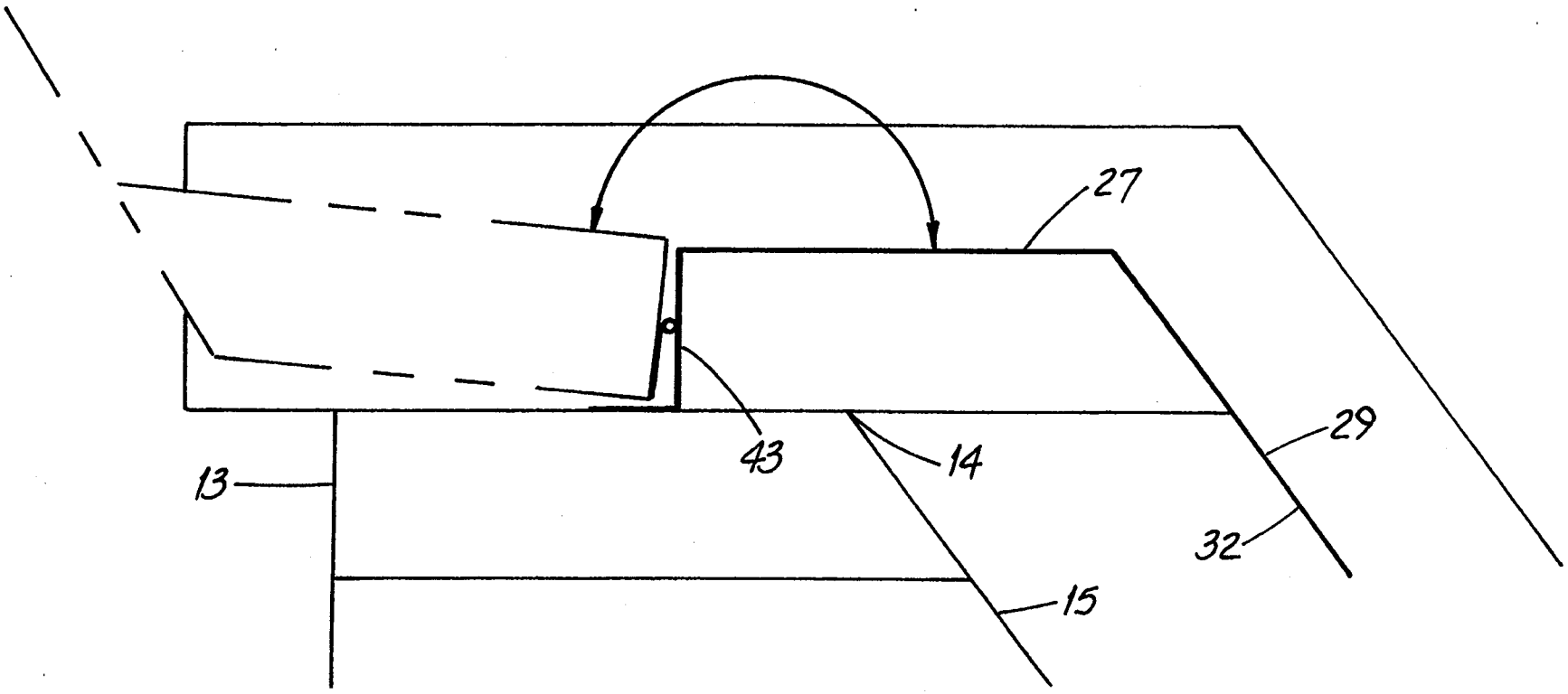
FIG. 4 is a schematic side view illustrating the movable mounting of the lighting fixture on the roof.

FIG. 4 shows one embodiment of the invention in which housing 27 is movably attached to roof top edge 14 to facilitate service including changing lamps. In such embodiment, housing 27 is pivotally attached along edge 14 by a hinge 43 having one hinge portion attached to the housing 27 and the other attached to top roof portion 13.

In operation, light fixture 10 directs light to roof middle and lower portions 15 and 17—brightly and evenly illuminating such surfaces. Because fixtures 10 are positioned between adjacent pairs of roof beams 21, the light from the fixtures also serves to illuminate beam sides 23 and silhouettes beam distal surfaces 25 against the roof 11. The roof is dramatically brighter and much more evenly lit than with prior lighting systems for such roofs.

Figure 5:
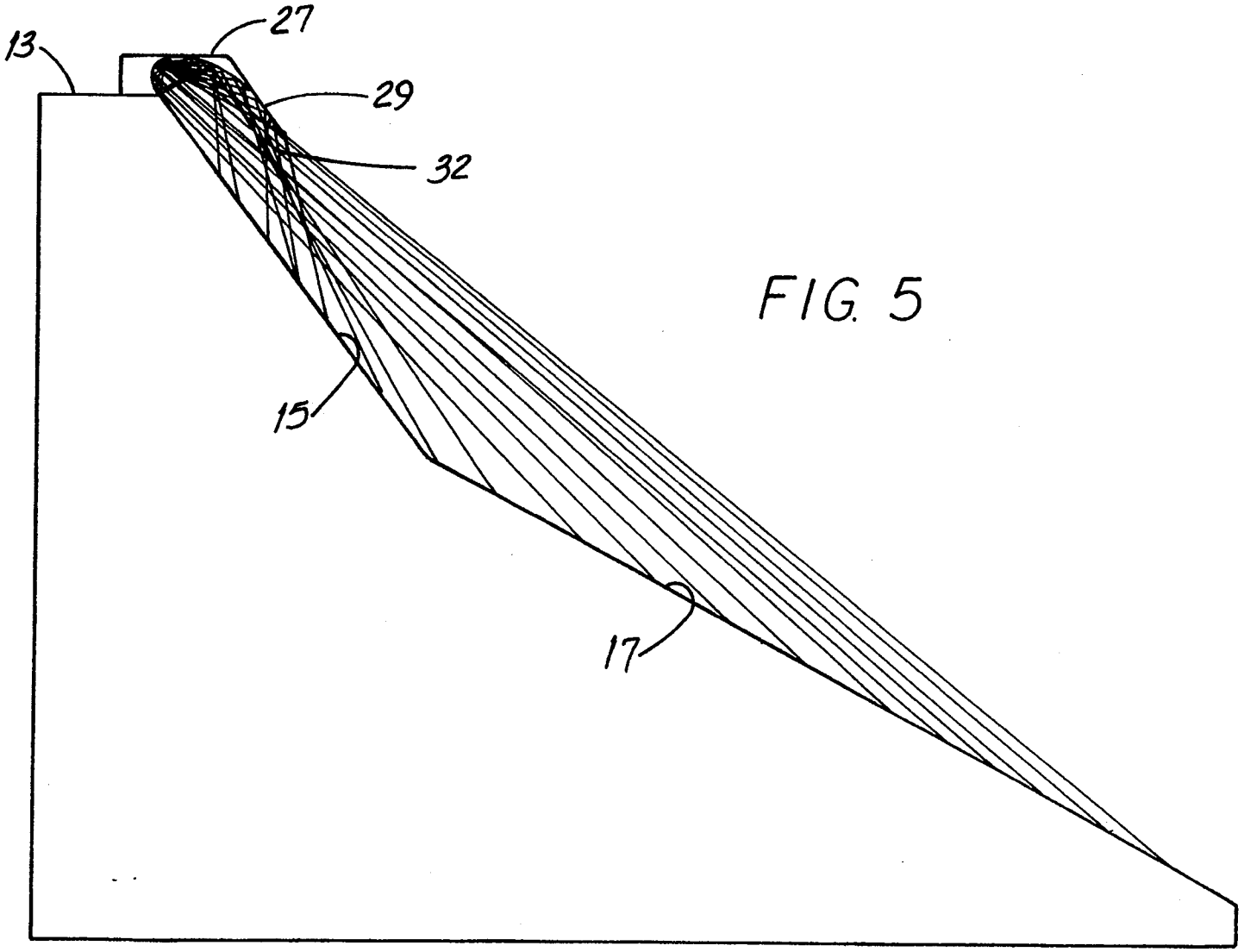
FIG. 5 is schematic side view of the lighting fixture and roof surfaces which includes a ray trace showing the lighting of the roof.

FIG. 5 is a ray trace showing the light path onto middle and lower roof portions 15 and 17, as directed by curved reflector 37. As depicted in FIG. 5, shroud 29 prevents people on the ground from being exposed to glare because it substantially prevents light from projecting beyond the edge of roof lower portion 17. The reflective material (not shown) coating the undersurface 32 of shroud 29 serves to enhance lighting of the middle portion 15 of roof 11.

Service and replacement of lamps may be performed easily by a person on top section 13 of the roof 11. A ladder or special support is not needed to service fixture 10. Service may be performed simply by pivoting the fixture 10 rearwardly at hinge 43, thereby providing access to the lamps and components.

While the principles of this invention have been described in connection with specific embodiments, it should be understood clearly that these descriptions are made only by way of example and are not intended to limit the scope of the invention.

What is claimed is:

1. In roof-mounted apparatus for illuminating a roof which has lower and middle angled roof portions intersecting to form a valley and a substantially horizontal roof top portion intersecting with the middle portion to form a top edge, the improvement comprising:

at least one elongate housing secured to and extending substantially horizontal along the top edge;

at least one lamp-mounting fixture secured with respect to the housing for supporting an elongate light source therealong;

a reflector in the housing behind and extending along the light source location and configured and arranged to direct light on the lower and middle roof portions; and a shroud secured to and extending along the housing and positioned in front of the light source location to limit light transmission beyond the lower portion of the roof.

2. The apparatus of claim 1 wherein:

the roof has a plurality of parallel spaced roof beams extending up the roof over the lower and middle roof portions and having an upper end section over the roof top portion; and the at least one housing is positioned between the roof beams.

3. The apparatus of claim 2 wherein the housing and shroud project no higher than the upper end sections of the roof beams.

4. The apparatus of claim 2 wherein each beam has a distal surface therealong and the housing and shroud project no higher than that portion of the distal surface which is adjacent to the housing and shroud.

5. The apparatus of claim 4 wherein the housing and shroud are recessed below the adjacent portion of the roof beam distal surface.

6. The apparatus of claim 1 wherein the housing forms a downwardly directed opening along substantially the entire length of the housing for projection of light toward the roof.

7. The apparatus of claim 6 wherein the opening is covered by a lens.

8. The apparatus of claim 1 wherein the housing is movably attached along the top surface of the roof to facilitate service including changing lamps.

9. The apparatus of claim 8 wherein the housing is pivotally attached along the top surface of the roof.

10. The apparatus of claim 1 wherein the lamp-mounting fixture is mounted within the housing.

11. The apparatus of claim 1 wherein the lamp mounting fixture is of the type for receiving the socket of an elongate light source.

12. The apparatus of claim 4 further comprising the reflector being configured and arranged to direct light so as to silhouette the distal surface of the roof beams.

13. The apparatus of claim 1 wherein the reflector has a profile which is curved to provide substantially uniform light distribution over the middle and lower roof portions.

14. The apparatus of claim 1 wherein the reflector substantially surrounds the light source.

15. The apparatus of claim 1 wherein the shroud is integrally formed with the housing.

16. The apparatus of claim 1 wherein the shroud is a separate component which is fastened to the at least one elongate housing.

17. The apparatus of claim 1 wherein the shroud is substantially parallel to the middle portion of the roof.

18. The apparatus of claim 1 wherein the shroud has an undersurface which is reflective so as to enhance the lighting of the middle portion of the roof.

* * * * *